United States Patent [19]

Fontaine

[11] Patent Number: 4,535,936

[45] Date of Patent: Aug. 20, 1985

[54] BLAST NOZZLE FOR BLOWING OFF LIQUIDS FROM SURFACES

[76] Inventor: Paul Fontaine, Max-Planck-Ring 6, D-4018 Langenfeld, Fed. Rep. of Germany

[21] Appl. No.: 530,350

[22] Filed: Sep. 8, 1983

[30] Foreign Application Priority Data

Sep. 14, 1982 [DE] Fed. Rep. of Germany ..... 3233963

[51] Int. Cl.[3] ..... B05D 1/04

[52] U.S. Cl. ..... 239/117; 239/597; 239/DIG. 21

[58] Field of Search ..... 239/114–118, 239/123, 597, DIG. 21

[56] References Cited

U.S. PATENT DOCUMENTS

| | | | |
|---|---|---|---|
| 2,283,768 | 5/1942 | Schueler | 239/116 |
| 2,803,496 | 8/1957 | Ransburg | 239/116 X |
| 4,392,613 | 7/1983 | Graff et al. | 239/115 |

FOREIGN PATENT DOCUMENTS

| | | | |
|---|---|---|---|
| 182501 | 6/1922 | United Kingdom | 239/117 |
| 1479293 | 7/1977 | United Kingdom | 239/118 |

*Primary Examiner*—Andres Kashnikow

*Attorney, Agent, or Firm*—Pearne, Gordon, Sessions, McCoy, Granger & Tilberry

[57] ABSTRACT

A blast nozzle for blowing-off liquids from surfaces, for example from sheet surfaces, has a tubular body, on the outer surface of which converging plate-like lips are provided which extend generally tangentially to form a blow-off slit which runs in an axially-parallel manner to the body. A plate-form cleaning element which may be moved relative to the blow-off slit is located in the body. The cleaning element is attached to a transmission which is adjusted by a drive provided outside the body. According to one embodiment, the cleaning element is a sheet which extends over practically the entire length of the blow-off slit and which may be selectively pushed into, and through, the blow-off slit, whereas according to another embodiment, it is a tongue which lies in the blow-off slit and which may be moved along that slit.

6 Claims, 5 Drawing Figures

BLAST NOZZLE FOR BLOWING OFF LIQUIDS FROM SURFACES

BACKGROUND OF THE INVENTION

1. Field of the Invention

This invention relates to a blast nozzle for blowing off liquids from surfaces, for example from a sheet metal surface, which nozzle has a tubular body, on the outer surface of which generally tangential, converging plate-like lips are provided to form a blow-off slit which extends in an axially-parallel manner to the body, and also a plate-form cleaning element which is located in the body and may be moved relative to the blow-off slit.

2. Description of the Prior Art

In a blast nozzle of this type which is already known (DE-OS No. 2,430,832), the plate-form cleaning element is positioned on a slide which is mounted movably on the inside of one lip and is actuated by pneumatic cylinders positioned inside the blast nozzle. Consequently, a remote control is possible, so that now and then the cleaning element may be pushed through the blow-off slit, without having to interrupt the operation of the blast nozzle for this purpose. However, the use of pneumatic cylinders in the blast nozzle is relatively expensive. The blast nozzle has to be opened for maintenance work on the hydraulic cylinders used as the drive.

An object of the present invention is to improve the previously known blast nozzle having a movable plate-form cleaning element, such that the drive for the cleaning element takes place from outside and only simple mechanical parts which do not disturb the blowing operation are located inside the blast nozzle.

SUMMARY OF THE INVENTION

According to the present invention, a blast nozzle of the initially mentioned type is provided in which the cleaning element is attached to a transmission for actuation by a drive provided outside the body of the blast nozzle.

Only one mechanical transmission is located inside the blast nozzle to move the plate-form cleaning element mounted therein, whereas the drive sits outside and is accordingly easy to maintain, even without interrupting the operation, if appropriate. The components of the transmission located inside the blast nozzle may be simple mechanical transmission components which do not require any particular maintenance, so that the blast nozzle has to be opened rarely, if ever, for maintenance work.

According to one preferred embodiment of the present invention, the transmission comprises at least two adjusting rods which extend perpendicular to the cleaning element, are each provided with an eccentric lever, connected to the cleaning element, and are mounted so that they can be rotated about their longitudinal axis. In this arrangement, each eccentric lever may engage with a roller in a seat positioned on the cleaning element, so that there is a link joint permitting movement between the cleaning element and the eccentric lever. The adjusting rods projecting from the body of the blast nozzle are connected to a common drive via the ends projecting from the nozzle, so that they are rotated together and move the cleaning element without the risk of tilting perpendicular to the blow-off slit. For example, the outer ends of the adjusting rods are connected to a pneumatic cylinder which is used as a drive, via a chain drive, which cylinder is attached, for example, to the outside of the nozzle body.

According to another preferred embodiment of the present invention, the cleaning element is a tongue-like sheet which permanently engages the blow-off slit and may be moved along this slit. Thus, in this case, the cleaning element has a relatively small width and does not extend over the length of the blow-off slit, but is movable to and fro along the slit. It cannot be moved perpendicular to the blow-off slit, as in the first embodiment of this invention mentioned above. In this arrangement, the tongue-like sheet is attached, for example, to a cable which extends parallel to the blow-off slit, is guided over deflection rollers, entrains the tongue-like sheet during movement and draws it through the blow-off slit. The cable may be operated, for example, by a handwheel positioned on the outside of the nozzle body. Thus, this embodiment of the present invention is particularly suitable for a simple manual operation, so that it is possible to dispense with an expensive drive motor which requires maintenance.

BRIEF DESCRIPTION OF THE DRAWINGS

Two embodiments of the blast nozzle according to the present invention are shown in the drawings, in which.

DETAILED DESCRIPTION OF PREFERRED EMBODIMENTS

Figure 1:
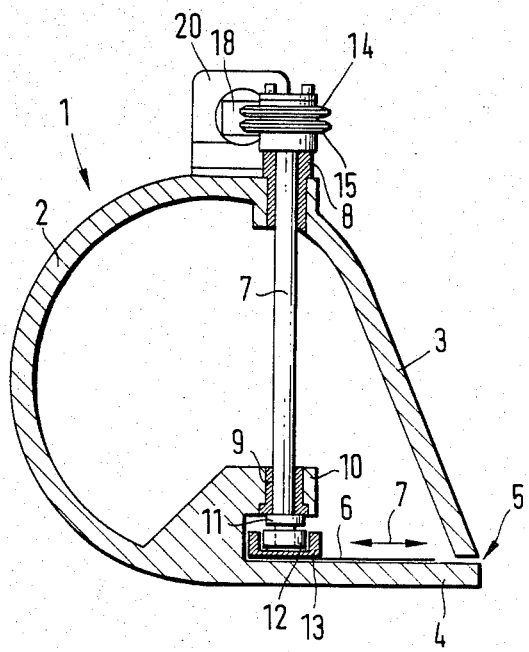
FIG. 1 shows a cross-section through a first embodiment of the blast nozzle.
Figure 2:
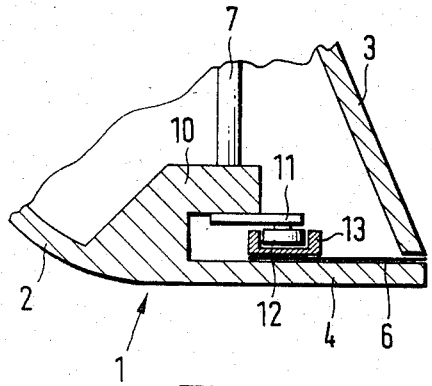
FIG. 2 shows a partial cross-section through the blast nozzle in the region of the lips forming the blow-off slit, the cleaning element being in a different position compared with that shown in FIG. 1.
Figure 3:
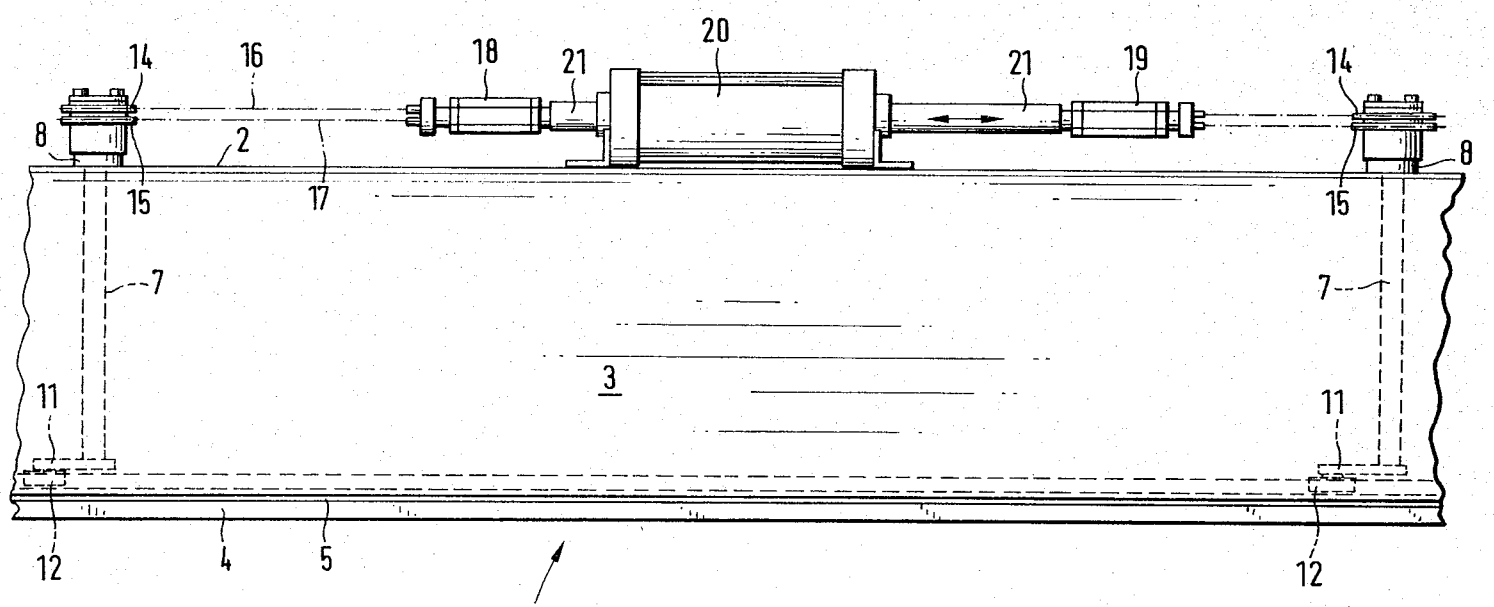
FIG. 3 is a front view of the blast nozzle from FIGS. 1 and 2.

The blast nozzle 1 shown in FIGS. 1 to 3 has a body 2 whose basic form is cylindrical with integral, tangentially extending plate-like lips 3 and 4 which terminate at a small spacing from one another, so that they form and delimit a blow-off slit 5 which extends over the length of the nozzle 1. It may be seen that the lower lip 4 runs generally horizontally in the embodiment shown, its inner surface delimiting the lower side of the blow-off slit 5. The other obliquely positioned lip 3 delimits the blow-off slit 5 with the surface of its outer end.

A sheet 6 which extends over the entire length of the blow-off slit 5 lies on the inside of the lip 4. This sheet 6 is designed as a plate-form cleaning element and it may be pushed backwards and forwards as indicated by the arrow 7 in FIG. 1. FIG. 1 shows the sheet 6 in its most retracted position, whereas FIG. 2 shows the sheet 6 in its moved-out position, in which it has been pushed out forwards through the blow-off slit 5. In this way, impurities deposited in the blow-off slit 5 may be discharged. The thickness of the sheet 6 corresponds approximately to the height of the blow-off slit 5, so that by moving the sheet 6 once out of the blow-off slit 5, this slit may be freed from all impurities located therein.

In the embodiment according to FIGS. 1 to 3, two adjusting rods 7 are provided to move the sheet 6.

These rods 7 are positioned parallel to and spaced from one another and mounted in bush-shaped bearings 8 and 9 so that they may be rotated about their longitudinal axis. The bearings 8 and 9 may be maintenance-free bearing bushes. The bearing 8 is positioned in the wall of the body 2, whereas the bearing 9 is positioned in an eye 10 which is located on the inside wall of the body 2 and lies at a spacing above the lip 4.

A horizontally extending lever 11 is attached at one end to the lower end of each adjusting rod 7 below the eye 10. A roller 12 is rotatably mounted on the lower side of this lever on the other end, and it engages in a seat 13 located on the top of the sheet 6. This lever 11 acts as an eccentric in order to move the sheet 6 between the end positions shown in FIGS. 1 and 2 while the corresponding adjusting rod 7 is rotated.

Two sprocket wheels 14 and 15 which are connected in a non-rotational manner to the relevant adjusting rod 7 are superimposed at the upper end of each adjusting rod 7, outside the bearing 8 and, thus, on the outside of the body 2 . A respective chain 16 and 17, runs round each sprocket wheel 14 and 15, the chain 16 connecting the corresponding sprocket wheels 14 of the two adjusting rods 7 and the chain 17 connecting the sprocket wheels 15 of the two adjusting rods 7. The chains 16 and 17 form with the horizontally positioned sprocket wheels 14 and 15 the rotary drive for the two adjusting rods 7, said rods always being rotated simultaneously due to the mutual coupling.

The rear leg of each chain 16 and 17 is interrupted, the corresponding ends each being positioned on a chain tensioner 18 and 19 respectively. A pneumatic cylinder 20 which is attached to the outside of the body 2 of the nozzle 1 is located between the chain tensioners 18 and 19. The chain tensioners 18 and 19 are positioned on the ends of a pneumatic cylinder piston rod 21 which project out of the two ends of the pneumatic cylinder 20. Thus, the two chains 16 and 17 are connected to the adjusting piston, which may be moved in the pneumatic cylinder 20, but is not shown here. Depending on which side of the adjusting piston is charged with a compressed agent or is relieved from pressure, the chains are moved in one or the other direction, so that the two adjusting rods 7 are rotated accordingly via the chain wheels 14 and 15 so as to push the sheet 6 out of the retracted position into the blow-off slit 5, or to retract it again. When the sheet 6 is in the retracted position as shown in FIG. 1, the adjusting piston of the pneumatic cylinder 20 does not need to be charged with a compressed agent on either side. Charging with a compressed agent is necessary only if the adjusting piston is to be displaced to move the sheet 6.

Figure 4:
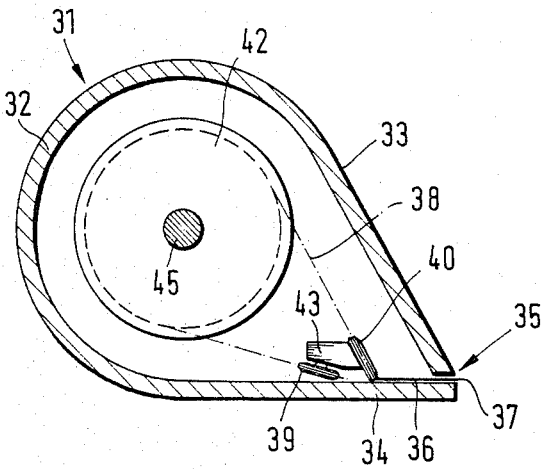
FIG. 4 shows a cross-section through a second embodiment of the blast nozzle according to the present and FIG. 5 is a top view of the blast nozzle shown in FIG. 4.
Figure 5:
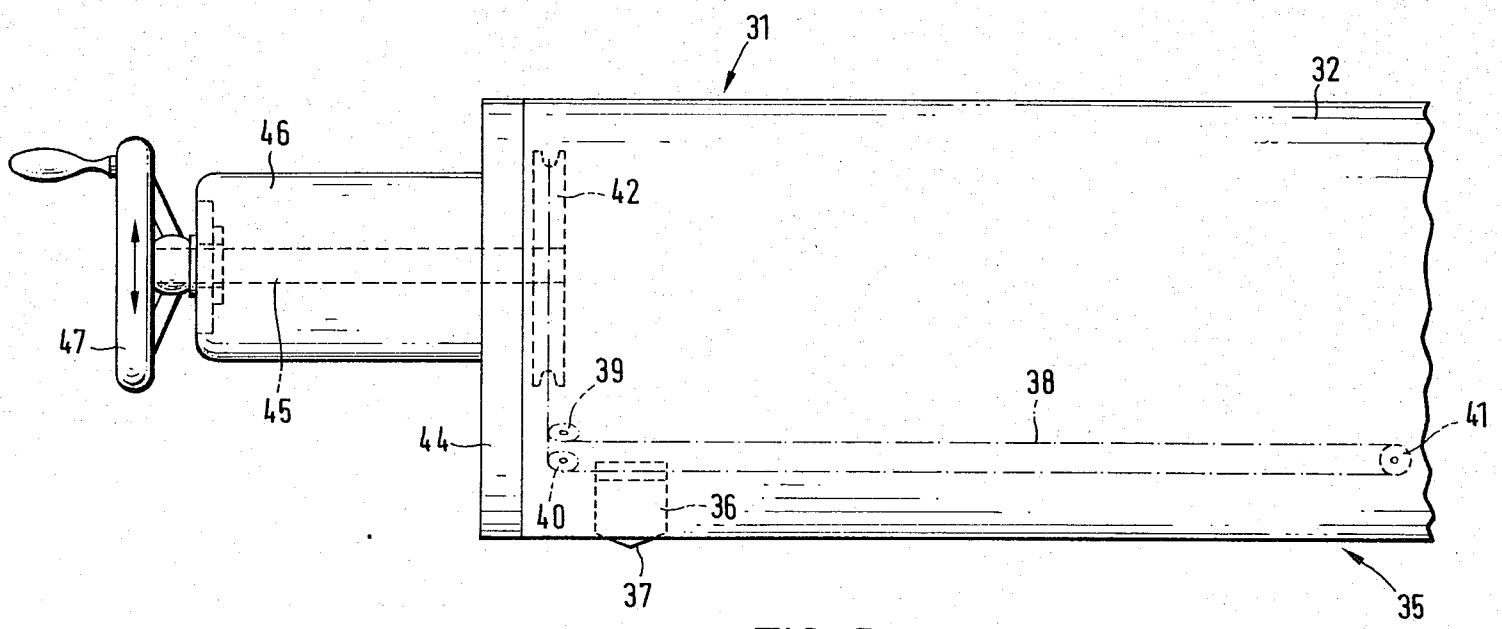

In the embodiment according to FIGS. 4 and 5, the basic form of the blast nozzle 31 is again a basically cylindrical body 32, from which plate-like lips 33 and 34 extend tangentially and in one piece forming and delimitting a blow-off slit 35 extending over the length of the body 32. A tongue-like sheet 36 lies on the inside surface of the generally horizontal lower lip 34 with its outer tip 37 always projecting from the blow-off slit 35, as shown in particular by FIG. 5, but as may also be seen in FIG. 4. Furthermore, FIG. 5 shows that the tongue-like sheet 36 is relatively narrow and, accordingly, extends only over a small portion of the length of the blow-off slit 35.

A wire cable 38 which is guided, under tension, over deflection wheels 39, 40 and 41 and over a driving wheel 42 is provided inside the body 32. FIG. 4 shows that the deflection wheels 39 and 40 are mounted on a block 43 which is attached to the front wall 44 of the body 32. The deflection wheel 41 is mounted inside the body 32 in a manner which is not shown in more detail, for example, directly on the inside of the lip 34.

The driving wheel 42 is attached to a shaft 45 which extends through a bearing housing 46 and is mounted therein. A handwheel 47 is attached to the outside of the shaft 46. The wire cable 38 may be moved using this handwheel 47 when the tongue-like sheet 36 which is used as the cleaning element is to be moved along the blow-off slit 35.

The wire cable 38 does not need to extend over the complete length of the body 32. Instead, it would also be possible to provide an arrangement at both ends of the body 32, as shown in FIG. 5, so that two tongue-like sheets 36 serving as cleaning elements could in each case be moved over approximately half the length of the blow-off slit 35.

What is claimed is:

1. A blast nozzle for blowing off liquids from surfaces, which nozzle has a tubular body, on the outer surface of which converging plate-like lips are provided in a generally tangential manner to form a blow-off slit extending axially-parallel to the body, and a plate-form cleaning element which is located in the body and may be moved relative to the blow-off slit, characterized in that the cleaning element is connected to a transmission actuated by a drive provided outside the body, the transmission comprising at least two spaced adjusting rods which extend perpendicular to the cleaning element, each of the adjusting rods being provided with an eccentric lever connected to the cleaning element and mounted for rotation about its longitudinal axis.

2. A blast nozzle according to claim 1, wherein one end of each adjusting rod projects from the body, and these ends are connected to a common drive.

3. A blast nozzle according to claim 1 or 2, wherein each eccentric lever engages with a roller in a seat located on the cleaning element.

4. A blast nozzle according to claim 2, wherein the projecting ends of the adjusting rods are connected via a chain drive to a pneumatic cylinder which is used as a drive.

5. A blast nozzle for blowing off liquids from surfaces, which nozzle has a tubular body, on the outer surface of which converging plate-like lips are provided in a generally tangential manner to form a blow-off slit extending axially-parallel to the body, and a plate-form cleaning element which is located in the body and may be moved relative to the blow-off slit, characterised in that the cleaning element is connected to a transmission actuated by a drive provided outside the body, the cleaning element comprising a tongue-like sheet which permanently engages in the blow-off slit and may be moved axially along said slit, the tongue-like sheet being attached to a cable which runs parallel to the blow-off slit and is guided over deflection rollers located within the body.

6. A blast nozzle according to claim 5, wherein the cable is to be operated by a handwheel positioned on the outside of the body.

* * * * *